United States Patent [19]

Check

[11] Patent Number: 4,562,956

[45] Date of Patent: Jan. 7, 1986

[54] DOMESTIC HOT WATER ZONE VALVE CONTROLLED EXTERNAL COIL

[76] Inventor: Robert F. Check, 130 Wahl Ave., Inwood, N.Y. 11696

[21] Appl. No.: 696,067

[22] Filed: Jan. 29, 1985

[51] Int. Cl.[4] ..... F24D 3/00

[52] U.S. Cl. ..... 237/8 R; 237/19; 126/362; 236/20 R

[58] Field of Search ..... 237/8 R, 19; 236/20 R; 126/362

[56] References Cited

U.S. PATENT DOCUMENTS 2,781,174 2/1957 Smith ..... 237/19

4,065,054 12/1977 Meier ..... 237/19

4,347,972 9/1982 Hillerstrom et al. ..... 126/362

*Primary Examiner*—Henry Bennett

*Attorney, Agent, or Firm*—Michael I. Kroll

[57] ABSTRACT

A domestic hot water zone controlled external coil which takes heated water from the hot water outlet of a hydronic boiler and passes the hot water through a tankless coil before returning it to the hydronic boiler. Return water from the tankless coil is returned to the hydronic boiler by using the existing circulator on an existing operating heating zone, which saves electrical energy. An aquastat and a unique analysis and switching circuit is also provided.

2 Claims, 2 Drawing Figures

DOMESTIC HOT WATER ZONE VALVE CONTROLLED EXTERNAL COIL

BACKGROUND OF THE INVENTION

1. Field of the Invention

The present invention relates generally to domestic water heating systems used in residential and commercial applications and, more specifically, to external tankless domestic hot water coils and to systems of controlling their operation.

2. Description of the Prior Art

At the present state of the art in domestic hot water heating systems two methodologies are primarily employed. The first requires the use of a separate domestic hot water heating system with separate heat source, typically oil, gas or electricity. This type of installation requires a large outlay of time and economic resources since the systems are expensive to purchase, expensive to install and require a great deal of storage space. The second methodology places a "tankless coil" into or adjacent to the source of heat used for space heating. While relatively simple to install, this technique provides limited volumes of domestic hot water since water to be heated passes once through the coil. Even very large coils yield limited hot water whose temperature falls as demand increases.

Numerous efforts have been made to find alternative techniques for heating domestic hot water. Joseph Roy et. al. in U.S. Pat. No. 4,037,779 provided a heating system having high-low temperature limit controlled auxiliary boiler; however, this system has a separate boiler with all the inherent disadvantages of the first methodology already described.

Charles Staats in U.S. Pat. No. 4,416,222 provided hot water heater circuitry which advanced the state of the art by providing a system whereby a single opening or port may be used for both inletting and outletting water from a typical hydronic boiler to an auxiliary hot water heater. However; this improvement does not address the problem of controlling flow through the auxiliary heater and does not address the means by which the auxiliary water heater operates; only the porting techniques.

Chetwood Smith in U.S. Pat. No. 1,591,647 provides an indirect domestic water heating system which uses an external heat exchanger to supply domestic hot water but controls the flow, and thereby the water temperature by a manually operated valve which provides a very limited ability to control water temperature.

SUMMARY OF THE INVENTION

It is, therefore, a primary object of the instant invention to provide a domestic hot water zone valve controlled external coil which can be connected to an existing hydronic boiler.

Another object is to provide a domestic hot water zone valve controlled external coil which requires no separate fuel source.

Another object is to provide a domestic hot water zone valve controlled external coil which requires no additional chimney or vent.

Another object is to provide a domestic hot water zone valve controlled external coil which can be installed over a boiler or underneath a sink or vanity.

Another object is to provide a domestic hot water zone valve controlled external coil in which the boiler does not have to maintain temperature but only operate on demand.

Another object is to provide a domestic hot water zone valve controlled external coil which can be shut off without affecting boiler operation.

Another object is to provide a domestic hot water zone valve controlled external coil which is simple to install and requires very little service.

Another object is to provide a domestic hot water zone valve controlled external coil which may be operated from an existing circulator boost pump to conserve electrical energy.

Another object is to provide a domestic hot water zone valve controlled external coil which will operate with narrow one-half inch feed and return lines.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
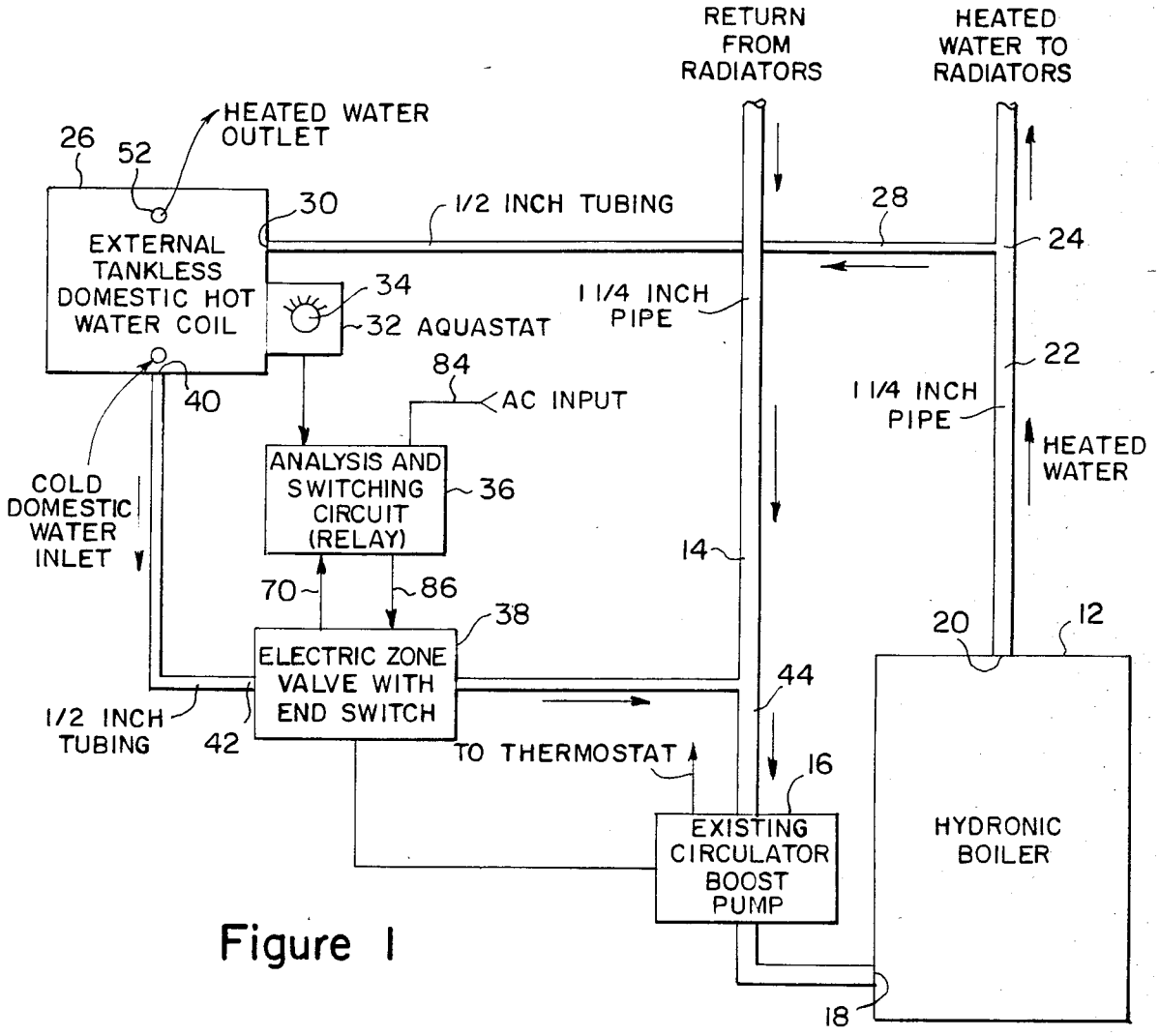
FIG. 1 is an electronic and fluid block diagram of the invention.

In normal boiler operation, return hot water from radiators on a typical heating zone is returned to hydronic boiler 12 via pipe 14 by existing circulator boost pump 16 which returns cooled water to hydronic boiler 12 through inlet port 18. Heated water returns to hot water radiators via pipe 22 by leaving hydronic boiler 12 at outlet port 20. In order to provide domestic hot water, the invention taps off heated hot water from tee 24 and conducts this heated water to external tankless domestic hot water coil 26 via pipe 28 and port 30.

Two alternative pathways are provided in order to cause water to flow through external tankless domestic hot water coil 26 and return to hydronic boiler 12 in a manner which produces hot water at a relatively constant temperature.

The demand hot water feature of the instant invention is attained when the temperature of the domestic hot water as sensed by aquastat 32 falls below the value set by temperature setting knob 34 the closure of switch contacts in aquastat 34 signals analysis and switching circuit 36 to energize existing circulator boost pump 16 and water is pumped from outlet port 40 on external tankless domestic hot water coal 26, through pipe 42, through electric zone valve with end switch 38, through pipe 44, through existing circulator boost pump 16 and back to hydronic boiler 12 via return port 18.

When domestic hot water is used cold tap water flows into external tankless domestic hot water coil through cold water tap inlet and exits as heated domestic hot water through heated water outlet 52.

Figure 2:
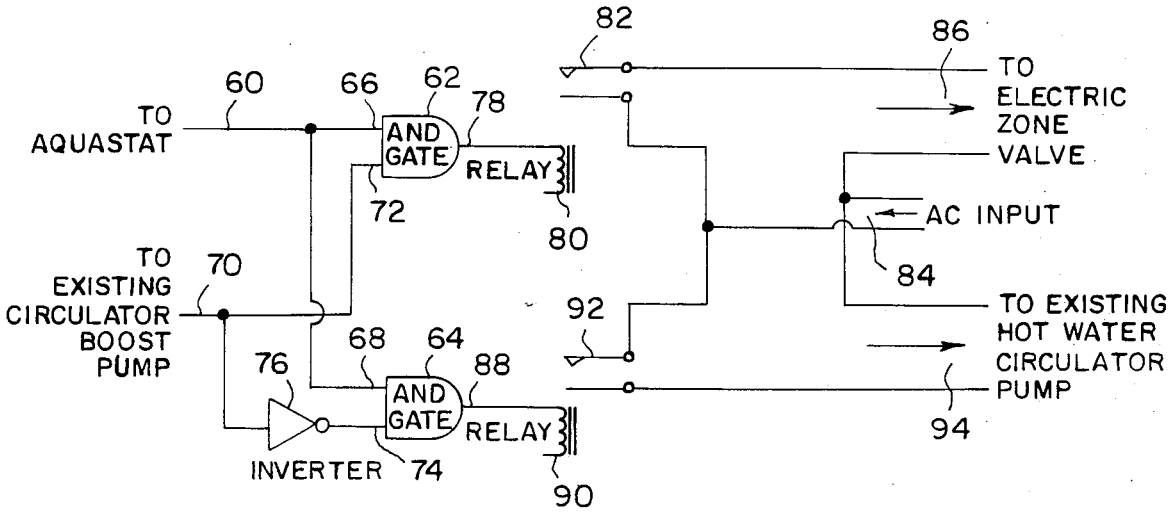
FIG. 2 is an electronic block diagram of the analysis and switching circuit.

The electronic and fluid control of the invention may be better understood with additional reference to FIG. 2. Aquastat contact closure signals at 60 are inputted to AND gates 62 and 64 at input 66 and 68 respectively. Existing circulator boost pump operating signals at 70 are inputted to AND gate 62 at input 72 and to AND gate 64 at input 74 after first passing through an inverter 76. If an aquastat closure signal is present at input 66 and an existing circulator boost pump signal is present at input 72, then an output signal is present at output 78, relay 80 is actuated, contacts 82 close and AC power is supplied from AC input 84 to electric zone valve power line 86. This corresponds to a condition in which the aquastat 32 is demanding heated water and existing circulator pump 16 is operating.

If an aquastat closure signal is present at input 68 and no existing circulator boost pump signal is present at the input of inverter 76, then inverter 76 outputs a signal which is fed to input 74. This produces an output signal 88, relay 90 is actuated, contacts 92 close and AC power is supplied from AC input 84 to existing hot water circulator pump power line 94. This corresponds to a condition in which the aquastat 32 is demanding heated water and existing circulator pump 16 is not then operating.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A domestic hot water zone valve controlled external coil comprising in combination:

(a) an external tankless domestic hot water coil which acts as a heat exchanger whose heat source is the output of a hydronic boiler wherein heated water is cycled from the outlet of said hydronic boiler through said external tankless domestic hot water coil and back to the inlet of said hydronic boiler whereby cold water enters said external tankless domestic hot water coil and is heated thus providing domestic hot water;

(b) an aquastat whose electrical contacts close when the temperature of said domestic hot water falls below some predetermined value; and, (c) an electric zone valve with end switch placed in the fluid circuit between the return line of said external tankless domestic hot water coil and the inlet line of a circulator boost pump used on an existing heating zone, whereby, when said circulator boost pump is operating and said contacts of said aquastat close, an analysis and switching circuit causes said electric zone valve and end switch to actuate thereby allowing said heated water to flow through said external tankless domestic hot water coil, said analysis and switching circuit which determines whether said electric zone valve or said domestic hot water circulator pump operates comprises two AND gates whose inputs are an aquastat contact closure signal and a circulator boost pump operating signal whereby one of said AND gates has an output signal which activates a relay which in turn activates said electric zone valve with end switch when both AND gate inputs are positive which corresponds to a condition in which said existing circulator boost pump is operating and said aquastat calls for increased hot water and whereby the other of said AND gates which has an inverter in said circulator boost pump operating signal input has an output signal which activates a relay which in turn activates said existing hot water circulator pump when said aquastat contact closure signal is positive and when said circulator boost pump operating signal is negative which corresponds to a condition in which said existing circulator boost pump is not operating and said aquastat calls for increased hot water.

2. A domestic hot water zone valve controlled external coil comprising in combination:

(a) an external tankless domestic hot water coil which acts as a heat exchanger whose heat source is the output of a hydronic boiler wherein heated water is cycled from the outlet of said hydronic boiler through said external tankless domestic hot water coil and back to the inlet of said hydronic boiler whereby cold water enters said external tankless domestic hot water coil and is heated thus providing domestic hot water;

(b) an aquastat whose electrical contacts close when the temperature of said domestic hot water falls below some predetermined value; and, (c) a domestic hot water circulator pump placed in the fluid circuit between the return line of said external tankless domestic hot water coil and the inlet line of said hydronic boiler, whereby, when said circulator boost pump is not operating and said contacts of said aquastat close, an analysis and switching circuit causes said existing hot water circulator pump to actuate thereby allowing said heated water to flow through said external tankless domestic hot water coil, said analysis and switching circuit which determines whether said electric zone valve or said domestic hot water circulator pump operates comprises two AND gates whose inputs are an aquastat contact closure signal and a circulator boost pump operating signal whereby one of said AND gates has an output signal which activates a relay which in turn activates said electric zone valve with end switch when both AND gate inputs are positive which corresponds to a condition in which said existing circulator boost pump is operating and said aquastat calls for increased hot water and whereby the other of said AND gates which has an inverter in said circulator boost pump operating signal input has an output signal which activates a relay which in turn activates said existing hot water circulator pump when said aquastat contact closure signal is positive and when said circulator boost pump operating signal is negative which corresponds to a condition in which said existing circulator boost pump is not operating and said aquastat calls for increased hot water.

* * * * *